US009957680B1

(12) United States Patent
Bargoot

(10) Patent No.: US 9,957,680 B1
(45) Date of Patent: May 1, 2018

(54) HANDHELD SNOW MELTER

(71) Applicant: Kyle Bargoot, Groton, MA (US)

(72) Inventor: Kyle Bargoot, Groton, MA (US)

( * ) Notice: Subject to any disclaimer, the term of this patent is extended or adjusted under 35 U.S.C. 154(b) by 395 days.

(21) Appl. No.: 14/937,116

(22) Filed: Nov. 10, 2015

(51) Int. Cl.

| | |
|---|---|
| ***E01H 5/10*** | (2006.01) |
| ***F23D 14/12*** | (2006.01) |
| ***F23D 14/28*** | (2006.01) |
| ***F23D 14/04*** | (2006.01) |

(52) U.S. Cl.
CPC ..... *E01H 5/10* (2013.01); *F23D 14/04* (2013.01); *F23D 14/125* (2013.01); *F23D 14/28* (2013.01); *F23C 2700/046* (2013.01); *F23D 2203/00* (2013.01)

(58) Field of Classification Search
CPC ..... F23C 2700/043; F23C 2700/046; F23D 14/02; F23D 14/04; F23D 14/12; F23D 14/14; F23D 14/145; F23D 14/28; F23D 14/30; F23D 14/38; F23D 14/40; F23D 2203/00; E01C 23/14; E21B 36/025
See application file for complete search history.

(56) References Cited

U.S. PATENT DOCUMENTS 3,179,156 A * 4/1965 Weiss ..... F23C 99/00 126/92 B
3,229,680 A * 1/1966 Hebert ..... F23D 14/18 126/92 B
3,540,429 A * 11/1970 Svensson ..... A47J 36/24 126/92 B
3,763,847 A * 10/1973 Guzdar ..... F23C 99/00 126/91 R
3,975,140 A * 8/1976 Placek ..... B60H 1/0025 126/92 B
4,452,225 A * 6/1984 Plant ..... F24C 1/10 126/213
4,624,241 A * 11/1986 Cherryholmes ..... F24C 15/22 126/92 B
4,782,814 A * 11/1988 Cherryholmes ..... F24C 1/12 126/92 B
5,009,592 A 4/1991 Roldan
5,060,629 A * 10/1991 Sirand ..... A01K 31/19 119/310
5,645,043 A * 7/1997 Long ..... F24C 1/10 126/91 R
5,649,824 A 7/1997 Stagg
6,408,843 B1 * 6/2002 Olson ..... A01M 21/04 126/271.1
7,631,640 B2 * 12/2009 Hofbauer ..... F23D 11/443 126/39 R
8,025,048 B1 9/2011 Scarborough
9,453,642 B2 * 9/2016 Arnold, III ..... F23D 14/56
2006/0083493 A1 4/2006 Dolton
(Continued)

FOREIGN PATENT DOCUMENTS

WO WO8300607 A1 3/1983

*Primary Examiner* — David J Laux

(57) ABSTRACT

The handheld snow melter is a handheld propane or stabilized methylacetylene-propadiene fueled parabolic heated intended for use in removing snow and ice. The handheld propane or stabilized methylacetylene-propadiene torch is used to heat a ceramic cone. The ceramic cone is mounted in a parabolic reflector that is used to direct the heat towards the snow or ice targeted by the user. The handheld snow meiter comprises a reflector, a torch attachment, and a grip.

12 Claims, 3 Drawing Sheets

(56) References Cited

U.S. PATENT DOCUMENTS

| | | | | |
|---|---|---|---|---|
| 2007/0113370 | A1 | 5/2007 | Trofe | |
| 2008/0274434 | A1* | 11/2008 | Burdsall | F16L 37/2445<br>431/344 |
| 2012/0093490 | A1 | 4/2012 | Steinberg | |
| 2013/0309620 | A1* | 11/2013 | Prull | A01M 21/04<br>431/353 |

* cited by examiner

HANDHELD SNOW MELTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of snow furnaces, more specifically, a device for melting snow.

SUMMARY OF INVENTION

The handheld snow melter is a handheld propane or stabilized methylacetvlene-propaddene fueled parabolic heated intended for use in removing snow and ice. The handheld propane or stabilized methylacetylene-propadiene torch is used to heat a ceramic cone. The ceramic cone is mounted in a parabolic reflector that is used to direct the neat towards the snow or ice targeted by e user.

These together with additional objects, features and advantages of the handheld snow melter will be readily apparent to those of ordinary skill in the art upon reading the following detailed description of the presently preferred, but nonetheless illustrative, embodiments when taken in conjunction with the accompanying drawings.

In this respect, before explaining the current embodiments of the handheld snow melter in detail, it is to be understood that the handheld snow melter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the handheld snow melter.

It is therefore important that the claims be regarded as including such equivalent construction insofar as they do not depart from the spirit and scope of the handheld snow melter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
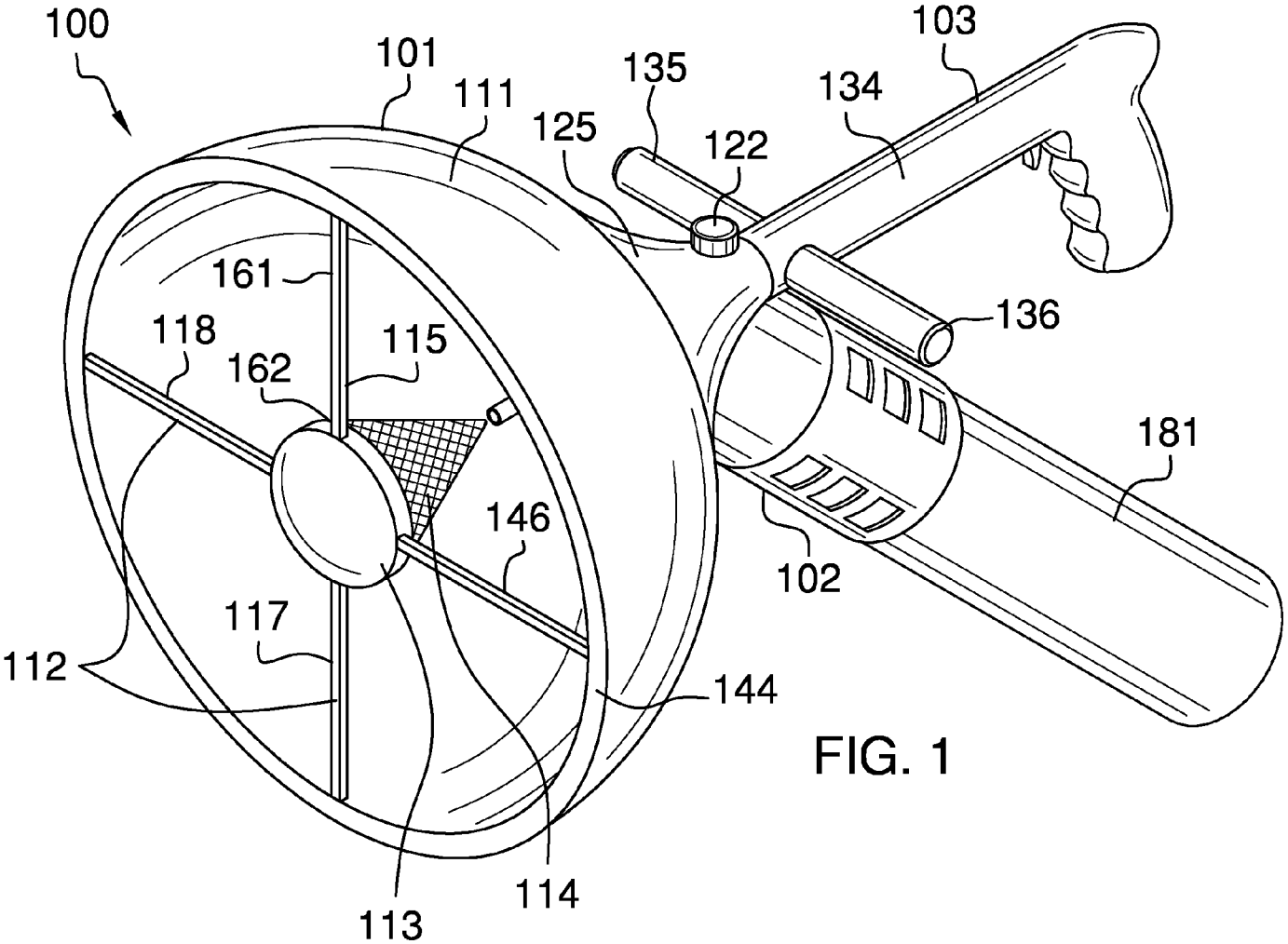
FIG. 1 is a perspective view of an embodiment of the disclosure.
Figure 2:
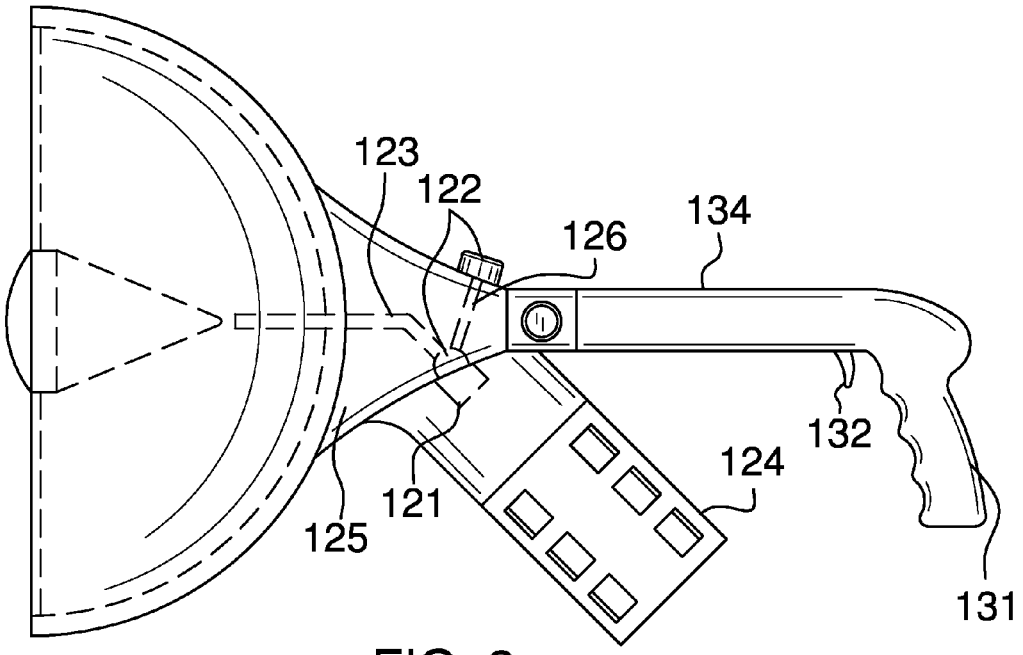
FIG. 2 is a front view of an embodiment of the disclosure.
Figure 3:
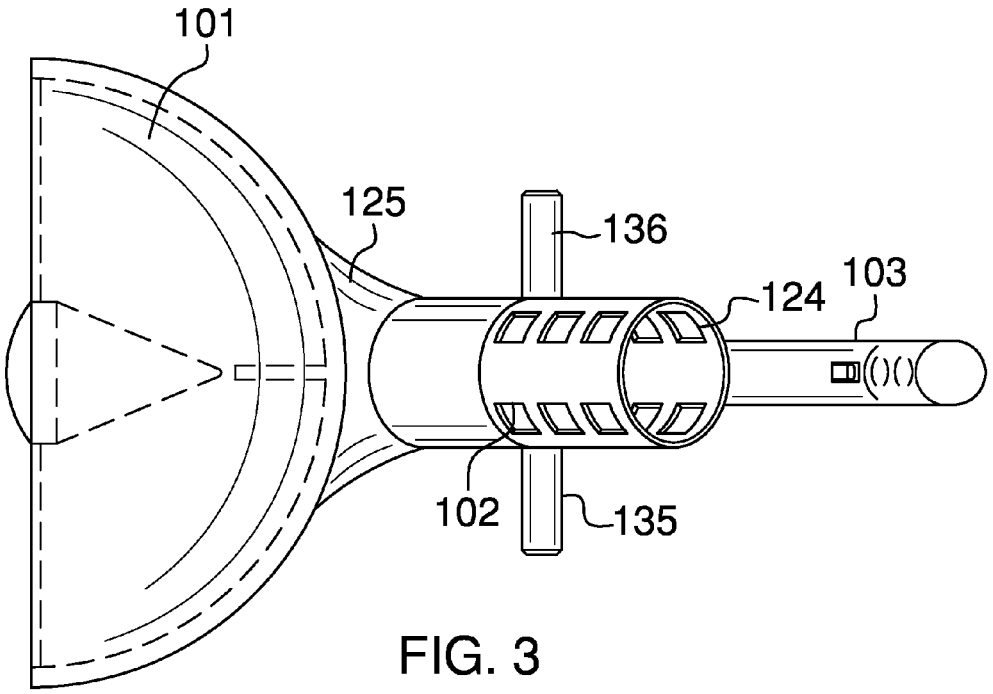
FIG. 3 is a bottom view of an embodiment of the disclosure.
Figure 4:
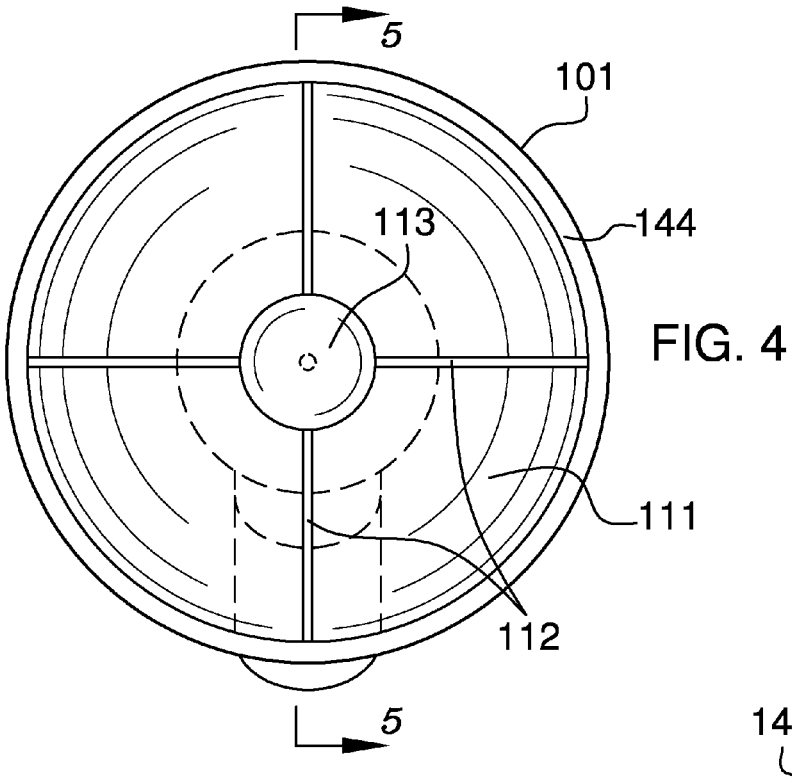
FIG. 4 is a side view of an embodiment of the disclosure.
Figure 5:
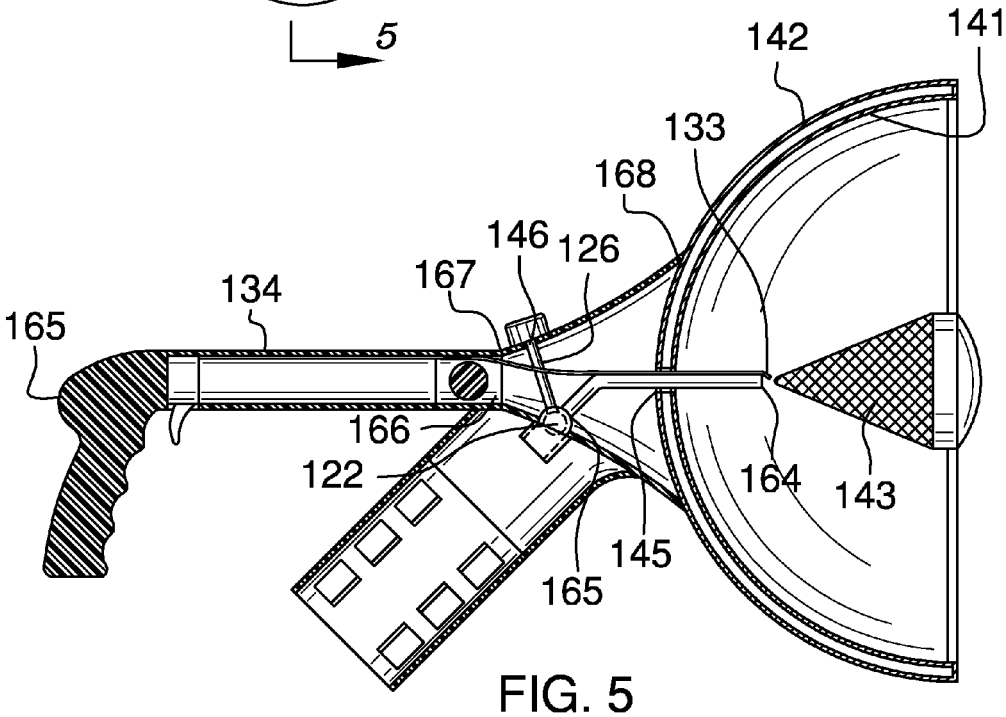
FIG. 5 is a cross-sectional view of an embodiment of the disclosure along line 5-5 in FIG. 4.

Detailed reference will now be made to a first potential embodiment of the disclosure, which is illustrated in FIGS. 1 through 5. The handheld snow melter 100 (hereinafter invention) comprises a reflector 101, a torchu attachment 102, and a grip 103. The invention 100 is adapted for use with commercially available propane or stabilized methylacetylene-propadiene fueled torch 181 (hereinafter torch).

The reflector 101 directs heat generated from the torch 181 towards the desired target. The reflector 101 further comprises a parabolic dish 111, a plurality of mounting bars 112, a ceramic cone 113, and a metal wrap 114. The parabolic dish 111 is the reflective device used to direct the heat generated by the torch 181. The parabolic dish 111 is a double walled parabolic reflector formed in the shape of a circular paraboloid. The parabolic dish 111 further comprises an inner wall 141 and an outer wall 142. The inner wall 141 is a made of metal and forms the heat reflecting surface of the parabolic dish 111. The outer wall 142 is a protective insulating surface that: 1) prevents heat loss in cold conditions; and, 2) prevents accidental burns from touching the inner wall 141. The outer wall 142 is made from a heat resistant insulating material such as fiber glass or poly-para-phenylene terephthalamide. The ceramic cone 113 is a ceramic structure formed in the shape of a cone. The ceramic cone 113 is mounted in the focal point of the parabolic dish 111. The ceramic cone 113 absorbs the heat generated by the torch 181 and transfers that heat back to the parabolic dish 111 for reflection. The face 143 of the ceramic cone 113 is covered in a metal wrap 114. The metal wrap 114 is a mesh formed of metal. The metal wrap 114 provides structural support for the ceramic cone 113 and distributes the heat generated from the torch 181 over the face 143 of the ceramic cone 113. The plurality of mounting bars 112 hold the ceramic cone 113 in position. Each of the plurality of mounting bars 112 is a metal bar that is further defined with a first end 161 and a second end 162. The first end 161 of each of the plurality of mounting bars 112 attaches to the edge 144 of the parabolic dish 111. The second end 162 each of the plurality of mounting bars 112 attaches to the ceramic cone 113. The second end 162 each of the plurality of mounting bars 112 can be attached directly to the ceramic cone 113 or can be attached to a locking collar that is subsequently attached to the ceramic cone 113. The plurality of mounting bars 112 further comprises a first mounting bar 115, a second mounting bar 116, a third mounting bar 117, and a fourth mounting bar 118.

The torch attachment 102 receives the torch 181 which is used to power the invention 100. The torch attachment 102 further comprises a tank connection 121, a regulator valve 122, a transport nozzle 123, a torch shroud 124 and a conical connector 125. The tank connection 121 is a screw connection which is adapted to receive the torch 181. Fuel is released from the torch 181 through the tank connection 121 and flows through the regulator valve 122. The regulator valve 122 is a commercially available threaded needle valve. The regulator valve 122 controls and regulates the flow of gas from the torch 181 into the transport nozzle 123. The transport nozzle 123 transports the gas released by the torch 181 through a nozzle hole 145 formed in the parabolic dish 111. The transport nozzle 123 is further defined with a third end 163 and a fourth end 164. The third end 163 is attached to the regulator valve 122. The fourth end 164 is open to the atmosphere within the parabolic dish 111 and releases gas from the torch 181 for use in combustion. In order to screw the torch 181 into the tank connection 121, the torch 181 is inserted into a torch shroud 124. The torch shroud 124 is a cylindrical structure that protects the torch 181 cylinder from damage.

The conical connector 125 is a hollow cone shaped structure that is used to house the torch attachment 102. The conical connector 125 further comprises a seventh end 167 and an eighth end 168. Both the seventh end 167 and the eighth end 168 are open. The seventh end 167 is at the narrow end of the cone that forms the conical connector 125. The eighth end 168 is at the broad end of the cone that forms the conical connector 125. The eighth end 168 of the conical connector 125 is attached to the outer wall 142 of the parabolic dish 111. The regulator valve 122 is mounted within the conical connector 125, however, a valve hole 146 is formed into the side of the conical connector 125 that allows a valve shaft 126 to pass through the valve hole 146 such that the valve shaft 126 can be used to operate the regulator valve 122.

The grip 103 is the handle that allows the invention 100 to be controlled and manipulated. The grip 103 further comprises a pistol grip 131, a trigger 132, an ignitor 133, a cylinder 134, a first handle 135, and a second handle 136. The structure of the grip 103 is formed from the pistol grip 131, the cylinder 134, the first handle 135 and the second handle 136. The structure of the grip 103 is formed from a heat resistant material. The grip 103 is further defined with a fifth end 165 and a sixth end 166. The pistol grip 131 is formed at the fifth end 165 of the grip 103. The pistol grip 131 is a handhold that is designed to allow the hand to wrap around the pistol grip 131 in a position similar to holding a glass or cup. The cylinder 134 is a hollow cylindrical object that creates the distance between the user and the reflector 101. The sixth end 166 of the grip 103 is attached to the seventh end 167 of the conical connector 125. A first handle 135 and a second handle 136 are attached to the cylinder 134 to allow for the use of a second hand in controlling the invention 100.

The ignitor 133 is used to start combustion of the gas flowing from the torch 181. The trigger 132 is used to initiate the ignitor 133. A commercially available trigger ignitor assembly provides both the trigger 132 and the ignitor 133. The trigger 132 is mounted near the pistol grip 131. The ignitor 133 is wired from the pistol grip 131 through the cylinder 134 and through the conical connector 125 to the fourth end 164 of the transport nozzle 123.

To use the invention 100, the regulator valve 122 is initially closed. The torch 181 is screwed into the tank connection 121. To start the use of the invention 100, the regulator valve 122 is opened and the trigger 132 is used to initiate the ignitor 133 will ignite the gas flowing from the torch 181. The regulator valve 122 is adjusted to the desired flame size. The invention 100 is then pointed towards the snow and ice that is to be melted. To discontinue use of the invention 100, the regulator valve 122 is closed.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A furnace comprising:

a reflector, a torch attachment, and a grip;

wherein the furnace is handheld;

wherein the furnace is adapted for use with a torch;

wherein the torch is fueled with a fuel selected from the group consisting of propane or stabilized methylacetylene-propadiene;

wherein the furnace is adapted for use in melting snow or ice;

wherein the reflector directs heat generated from the torch towards the snow or ice;

wherein the reflector further comprises a parabolic dish, a plurality of mounting bars, a ceramic cone, and a metal wrap;

wherein the parabolic dish is a double walled parabolic reflector formed in the shape of a circular paraboloid;

wherein the parabolic dish further comprises an inner wall and a outer wall, wherein the inner wall is a made of metal and the outer wall is made from a heat resistant insulating material;

wherein the ceramic cone is a ceramic structure formed in the shape of a cone;

wherein the ceramic cone is further defined with a face;

wherein the ceramic cone is mounted at the focal point of the parabolic dish; and wherein the face of the ceramic cone is covered in a metal wrap.

2. The furnace according to claim 1 wherein the ceramic cone is held in position using the plurality of mounting bars.

3. The furnace according to claim 2 wherein the torch attachment receives the torch.

4. The furnace according to claim 3 wherein the torch attachment further comprises a tank connection, a regulator valve, and a transport nozzle, a torch shroud and a conical connector.

5. The furnace according to claim 4 wherein the tank connection is a screw connection that is adapted to receive the torch.

6. The furnace according to claim 5 wherein the regulator valve is a needle valve that is attached to the tank connection.

7. The furnace according to claim 6 wherein the transport nozzle is a pipe;

wherein the transport valve is further defined with a first end and a second end;

wherein the first end is connected to the regulator valve;

wherein the second end is located within the reflector;

wherein the second end is open to the atmosphere.

8. The furnace according to claim 7 wherein the grip further comprises a pistol grip, a trigger, and an igniter.

9. The furnace according to claim 8 wherein the grip is formed from a heat resistant material.

10. The furnace according to claim 9 wherein the pistol grip is a handhold;

wherein the trigger is mounted on the pistol grip that is designed to allow the hand to wrap around the pistol grip in a position similar to holding a glass or cup.

11. The furnace according to claim 9 wherein the trigger is connected to the igniter;

wherein the trigger initiates the operation of the igniter.

12. The furnace according to claim 11 wherein igniter is used to start combustion of the gas flowing from the torch.

* * * * *